US005212002A

United States Patent [19]

Madrzak et al.

[11] Patent Number: 5,212,002

[45] Date of Patent: May 18, 1993

[54] SPLICE AND PROCESS FOR MAKING A SPLICE ON THE LEADER OF A PAPER ROLL

[75] Inventors: Zygmunt Madrzak, Heidenheim; Bernd Kaufmann, Steinheim, both of Fed. Rep. of Germany

[73] Assignee: J. M. Voith GmbH, Fed. Rep. of Germany

[21] Appl. No.: 679,779

[22] Filed: Apr. 3, 1991

[30] Foreign Application Priority Data

Apr. 3, 1990 [DE] Fed. Rep. of Germany ..... 4010704
Oct. 25, 1990 [DE] Fed. Rep. of Germany ..... 4033900

[51] Int. Cl.[5] ..... A61F 13/02

[52] U.S. Cl. ..... 428/40; 428/41; 428/42; 428/43; 428/57; 428/58; 428/194; 428/195; 428/202; 428/137; 428/138; 428/354; 428/906; 242/58.1; 242/58.5

[58] Field of Search ..... 428/40, 194, 42, 202, 428/195, 343, 354, 57, 58, 41, 956, 43, 137, 138, 131; 206/389; 242/58.1, 58.5

[56] References Cited

U.S. PATENT DOCUMENTS 2,060,906 11/1936 Snyder ..... 428/57
2,574,152 11/1951 Lewis ..... 428/40
2,800,215 7/1957 Converse ..... 428/194
5,104,701 4/1992 Cohen ..... 428/194

*Primary Examiner*—Ellis P. Robinson
*Assistant Examiner*—Nasser Ahmad
*Attorney, Agent, or Firm*—Baker & Daniels

[57] ABSTRACT

For making a web connection, an adhesive tape is used which essentially features on only one side an adhesive layer. The cover foil of this adhesive layer is comprised of two parts that are separated by a longitudinal seam. Applied on the other side of the substrate of the adhesive layer is at least one narrow adhesive strip, also having a cover foil, which preferably is contained on an edge of the adhesive tape.

15 Claims, 4 Drawing Sheets

SPLICE AND PROCESS FOR MAKING A SPLICE ON THE LEADER OF A PAPER ROLL

BACKGROUND OF THE INVENTION

The invention concerns a splice or the leader of a paper roll, and a process for making such a splice. Adhesive tapes have been utilized which on one side feature the adhesive layer, or adhesive layers, for taping the end of the old web and the leader of the new roll. Part of this adhesive layer is glued underneath the start of the new paper roll.

There is a prior process for making seam splices on running webs, on unwinding devices, for instance for coaters, where a double-sided adhesive tape is applied on the end of the web wound into a paper roll. Once the web and has then been fixed on the paper roll, the second cover foil of the adhesive tape is removed so that when pushing down on the old web passing the paper roll the ends of the webs are being spliced. The disadvantage encountered is that in the following coater, for instance on a blade serving as a doctor element for the coating mixture, the front end of the joined paper web causes a heavy jolt on the blade. Furthermore, a certain, although small, sump of coating mixture also is created at this point, tending to contaminate subsequent rolls, reversing rollers etc.

The problem underlying the invention is to propose a splice and an adhesive tape which makes it possible to make a web splice without the aforementioned disadvantages, where specifically only a slight jolt and a low joint edge of the web are supposed to be given at a future splicing of the running web(s).

SUMMARY OF THE INVENTION

This problem is inventionally solved through the features of the present invention. An adhesive tape features on its backside as well an adhesive layer, which as the case may be, may be strip-shaped or dot-shaped, or at least a double-stick adhesive strip, by means of which it is glued, with the outermost winding taut, on the latter or on the paper roll, at the end of the outermost roll winding.

A favorable process for making a splice at the leader of a paper roll using adhesive tapes of the present invention is characterized by the following features: (a) the web leader is kept distant from the paper roll, for instance by forming a loop which is temporarily fixed on the paper roll at the edge of the leader; (b) the adhesive tape is applied either on the loop, after removal of a cover foil, with the adhesive layer corresponding to the cover foil, or the adhesive tape is applied on a spot of the paper roll exposed through the removal of the web leader, with the adhesive layer of the adhesive strips or corresponding adhesive films, as well parallel to the axis of the paper roll; (c) facultatively upon elimination of the loop or removal of the cover foil closer to the exposure spot of the web leader from the paper roll, the paper roll and web leader are taped together while the web is wound taut; and (d) the overhang tail of the web leader, at the joint of the removed cover foil toward the remaining cover foil of the one web side, is detached, preferably by tearing it off by hand.

A favorable device for making a splice is also described. A device, specifically a paper roll carriage provided with it, is provided for application of an adhesive tape on the web leader of a paper roll or on the paper roll parallel to its center. A guide rail extending parallel to the paper roll is provided, having a guideway for a cassette or unwinding device containing the adhesive tape roll.

BRIEF DESCRIPTION OF THE DRAWINGS

The above mentioned and other features and object of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DESCRIPTION OF THE PREFERRED EMBODIMENT

In FIGS. 1 and 4 through 6, the adhesive layer is indicated by dashed line. Corresponding or similar components, for instance cover foils, are signified in the various drawings using the same reference symbols, but with a varying number of prime signs.

Figure 1:
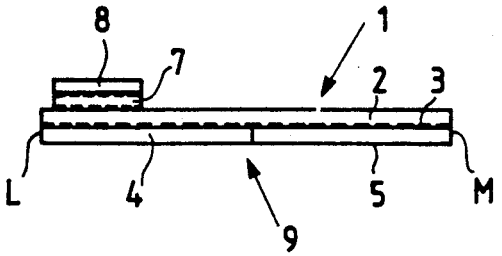
FIG. 1 shows the inventional adhesive tape.

FIG. 1 shows the adhesive tape 1 consisting of the backing 2 for the adhesive layer 3, and the cover foils 4 and 5 separated from each other by a longitudinal seam 9 and adhering to the adhesive layer 3. The further, narrow, double-stick adhesive strip (also adhesive tape) 7 with another cover foil 8 is also shown. The adhesive strip 7 may also be substituted by a number of adhesive dots or adhesive areas.

The adhesive force of the adhesive layer of the adhesive strip 7 contained underneath the cover foil 8 is considerably greater than the adhesive force of the adhesive layer on the other side of this adhesive strip 7. The adhesive tape on the web end C of the paper roll being fastened, according to FIG. 2, by means of and on this adhesive strip, the adhesive strip adheres more so to the paper roll, and not to the adhesive tape 1, as the web end is torn off due to the traction of the old web in splicing the two webs. This keeps the thickness of the joint at the doctor element (coating blade S) of FIG. 3 low. Hence, also only a very slight amount of coating mixture can accumulate at the joint.

The adhesion of the adhesive strips 6, 7 (or 10), each of which may also be a sole adhesive layer, will preferably be made less on the side facing the adhesive tape 2, etc., than on the other side. To that end, the adhesive surfaces on both sides may be varied in size, with equal adhesion on both sides.

The adhesive strip 7 (also 6, 10, in FIG. 4; 11, in FIG. 5) follows the splice at the distance of a paper roll circumference and thus, as the case may be, can remote paper web remnants that may have remained back on the doctor element and are created as the old paper web is pulled off its core, which is very important for the quality of the applied coating. Adhesive strip 7 (or 6, 10, etc.) extends parallel to the longitudinal web edges L, M.

The "end" C of the paper web, naturally, is here the "leader" of the paper roll A.

Figure 2:
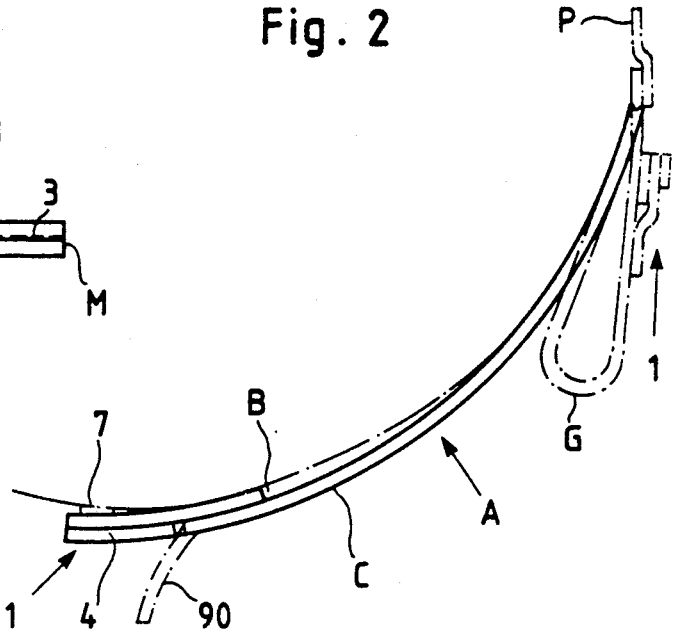
FIG. 2 shows a section of the paper roll provided with the finished joint.

Illustrated in FIG. 2 is the condition where the adhesive tape 1, for one, is tacked onto the paper web end C of the paper roll A, and at that, on the side facing toward the interior of the paper roll and, for another, on the outward-facing side B of the same lap of the paper web. This may be accomplished by, e.g., manually flapping the end of the paper web C back into the dashed position (loop G), in which this end is temporarily fastened on the paper roll with adhesive pieces (P). In the arrangement according to FIG. 2, therefore, the cover foil 5 is already peeled off on the one side of the adhesive tape 1. For making the joint between the ends of the web according to FIG. 3, also the other part of the cover foil 4 is pulled off the adhesive tape 1. This enables at this point the connection of the web end C with the old web D. The arrows in FIG. 3 indicate the running direction of the web. It is also evident from FIG. 3 that the narrow adhesive strip 7 still clings to the paper roll, that is, is separated from the adhesive tape 1, and at that, at a point where a reinforcement tape 70 is additionally taped on the paper roll which, however, may often also be omitted.

As the case may be though, an adhesive tape as described above may not be available, for which reason overall a process for making a splice is proposed and described hereafter in detail using various tape formations. In this case, the adhesive strip, for instance 6 or 7, may also be an appropriately wide adhesive film.

As stated above, the leader of the new paper roll is folded over to a loop G and taped in place on the paper roll using small adhesive tape pieces P. For instance, the cover foil 5 of the adhesive tape 2 is then removed and the latter is taped with its adhesive surface down on the leader C, parallel to the axial web edge (leader=front web end). Next, a narrow double-stick adhesive strip 7 with cover foil 8 according to FIG. 1 is affixed on the adhesive tape 2 here, for instance on the unaffixed end (since the cover foil 4 is still contained there) in the area of the longitudinal web edge. All this may be performed manually or also by means of an unwinding device for tape which is installed on a rail that is parallel to the paper roll. The expression "narrow adhesive strip" (or adhesive film) means here that it does not have the full width but, e.g., only a width of maximally 80% of the width of the adhesive tape 2, 2' etc. In the framework of the invention "narrow" adhesive tapes are favorably to be used therefor.

Figure 4:
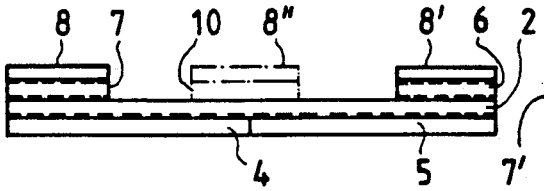
FIGS. 4–7 show additional adhesive tape formations, such as in FIG. 1, each in a view transverse to the longitudinal expanse of the tapes.

According to FIG. 4, the adhesive tape 2 may also be provided with several smaller adhesive strips 6, 7, as the case may be also 10, with cover foils 8, 8' and 8'' on their nonstick side.

Figure 5:
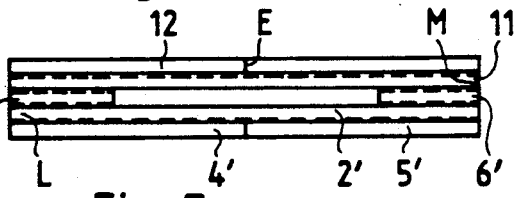

Another tape formation is depicted in FIG. 5, where another adhesive tape 11 of the same width as the adhesive tape 2' with cover foil 12 is applied on the two marginal adhesive strips 6' and 7', where the cover foil may additionally feature a separating point E, analogous to the separating point of the cover foils 4, 5 or 4', 5'. The sections of the cover foil can then be pulled off successively and the adhesive tape 11, and thus also the adhesive tape 2' and thus also the leader C can be fastened firmly on the paper roll.

Figure 6:
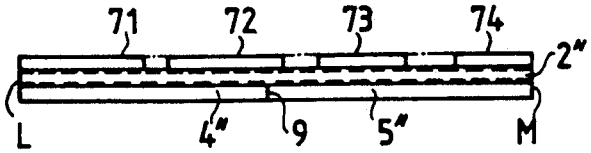

FIG. 6 illustrates an adhesive tape with a double-sided adhesive coating. It possesses on the one side, as described so far, the divided cover foils 4'' and 5'' and on the other side a strip-shaped adhesive layer, such as indicated by the dashed lines, with the individual film strips covered each by a cover foil 71 through 74. While firmly attaching the web leader C to the paper roll, these cover foils can be removed successively and the adhesive tape 2'' fastened firmly on the paper roll.

Figure 8:
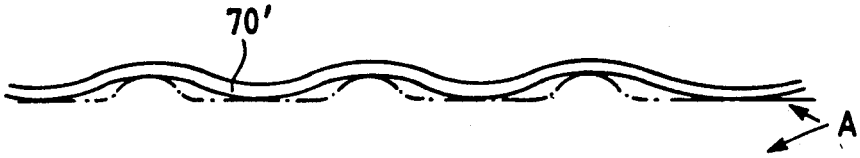
FIG. 8 shows a view transverse to the axis of the paper roll, of the area of the web leader.

This takes place, as the case may be, at a point where an additional adhesive tape according to FIG. 8 is applied on the next to the last lap of the paper roll. This is preferably a single-sided adhesive tape 70' used when the paper roll has in axial direction undergone a wavy deformation and formed grooves, due to the effect of moisture. In this case, the adhesive tape 70' adheres strongly to the bumps in the paper roll A, and the narrow adhesive strips 6, 7 or 10 or the adhesive strips 11 (FIG. 5) or 2'' (FIG. 6) adhere then very well to this additional adhesive tape 70'.

Figure 3:
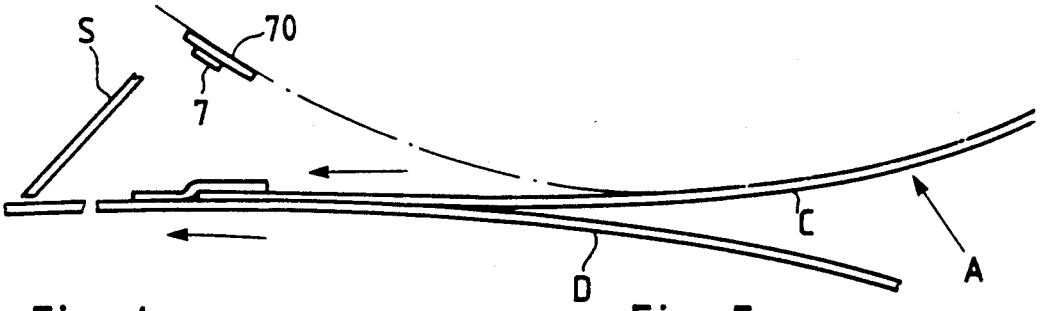
FIG. 3 shows the conditions on a subsequent coating blade S of a coater.

Taped directly on the wavy paper roll, refer to FIG. 8, the additional tape 70' is relatively wide, as is evident from FIG. 3, allowing all of the narrow adhesive strips 6, 7 to adhere to it. This additional adhesive tape 70 or 70' has an adhesive layer of a very high adhesive strength so that in the splicing process, in which the leader of the new web, that is the paper roll A, is connected with the old web D at a high speed, this additional adhesive tape including the narrow adhesive strips 6, will continue to stick to the paper roll, and thus separate from the major adhesive tape 2.

Figure 7:
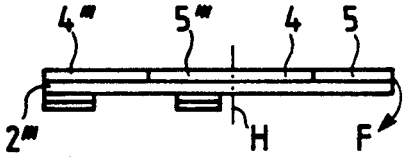

Indicated in FIG. 7 is additionally a variant of the adhesive tape formation according to FIG. 5, where an adhesive tape twice as wide is used which approximately in the center features a heavy perforation H, so that the tape formation according to FIG. 5 can be obtained by folding over in the direction of arrow F. To that end, the small adhesive strips 6' and 7' are suitably provided here also, as indicated in FIG. 7. This adhesive tape is provided on the adhesive side completely with cover foils that are subdivided in longitudinal direction, as indicated. Thus, also the design of the cover foils corresponds in this case to that according to FIG. 5.

Concerned are relatively large adhesive areas that pertain to the cover foils 4, 5, 4', 5' or 4'', 5'' in order to later, in the splice device (for so-called "flying splices"), splice the running webs flawlessly.

Any protruding tail 90 of the paper leader C that is created when the adhesive tape is not affixed exactly aligned on the otherwise absolutely straight axial web edge can be retroactively detached, for instance simply torn off by hand, along the bordering axial edge of the remaining cover foil 4, 4'.

It is conceivable that the tape configurations according to FIG. 1 and 4 through 7 can be manufactured and thus be commercially available. In this case, the process described so far is simplified, as will be described hereafter.

In the case of FIG. 2, the adhesive tape 1 or 2 is not affixed to the loop G, but directly to the paper roll A, for instance partly to the following winding B, and at that, with the narrow adhesive strip 7 or in case several are available with the adhesive strips 7, 8 or 10 or with appropriate adhesive films applied on the backside of the adhesive tape 2. Cover foils 8, 8' or 8'' that are present, naturally, are removed previously. The loop G to be formed is sufficiently large so that the web leader C, upon eliminator of the loop, can still be taped well at the spot distant from the cover foil 5, according to FIG. 2. A certain end even needs to protrude as a "tail" 90 which then is preferably removed by hand in that, e.g., along the edge of the adhesive layer or the still present cover foil 4 this "tail" is torn off. This makes for a very simple process of making the splice, without requiring expensive mechanisms. Naturally, it is possible to provide a simple device with a linear guide for affixing the adhesive tapes to the paper roll. Also, making a loop G may be omitted, permitting the loose web end simply to hang down vertically according to FIG. 2.

However, FIG. 2 indicates by broken line that the tape 1 may also be attached to the loop G from outside.

Figure 9:
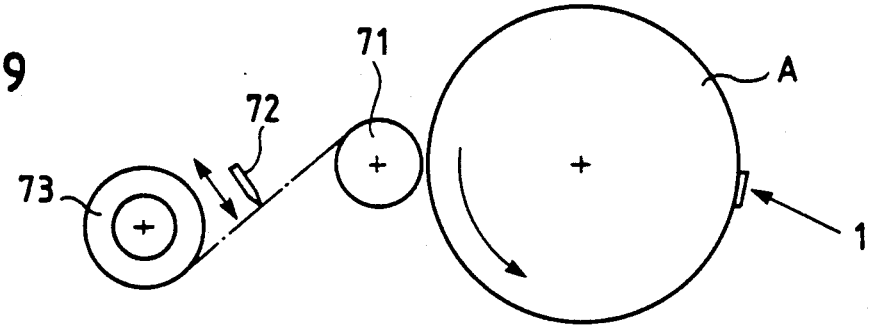
FIG. 9 shows a splicing operation on a rewinding device.

FIG. 9 shows basically how the process just described can also be applied very well in a rewinding device for a paper roll, by stopping the new paper roll (i.e., naturally, at the same time also the old one) in the rewinding process. The adhesive tape 1 or one of the other configurations according to FIGS. 4–7 is then glued in the last described way, so to speak with the "backside" on the paper roll, as indicated by arrow 1. The front side is then that which preferably contains the continuous adhesive layer with the cover foils 4 and 5 or 4' and 5' or 4'' and 5''. The one cover foil, in the examples always 5 or 5' or 5'', is first separated. Next, the paper roll is rotated in the direction of rotation as indicated by the round arrow until the web 1 has passed the squeeze point in the press gap between the press roll 71 and the paper roll. During this passage, the future web leader C is attached to the paper roll A by means of the adhesive tape 1. The new paper roll can then be separated from the old paper roll 73 with the cutter, as indicated at 72, previously or only subsequently. The overhang "tail" of the new paper roll A is then, as described above, separated along the joint of the cover foils 4 and 5, preferably by hand. As said before, the cover foil 4 remains generally still on the adhesive tape, since that foil is separated only when making the final splice in processing the paper roll.

This process, as the case may be, may also be modified in that the adhesive tape is applied with the front side, i.e., after removal of the one cover foil part 4 or 5, 4' or 5', 4'' or 5'', on the web end in the area of the contact roll 71, in that then, as the case may be, the cover foils 8, 8', 8'' of the smaller adhesive strips 6 or 7 or 10 are pealed off and the tape, and thus the web end, i.e., actually the new web leader C, is taped to the new paper roll A by means of these adhesive strips, which may be accomplished in that the new paper roll A is rotated somewhat in the direction of winding, so that the adhesive tape will pass the squeeze point between the contact roll 71 and the new paper roll A.

Figure 10:
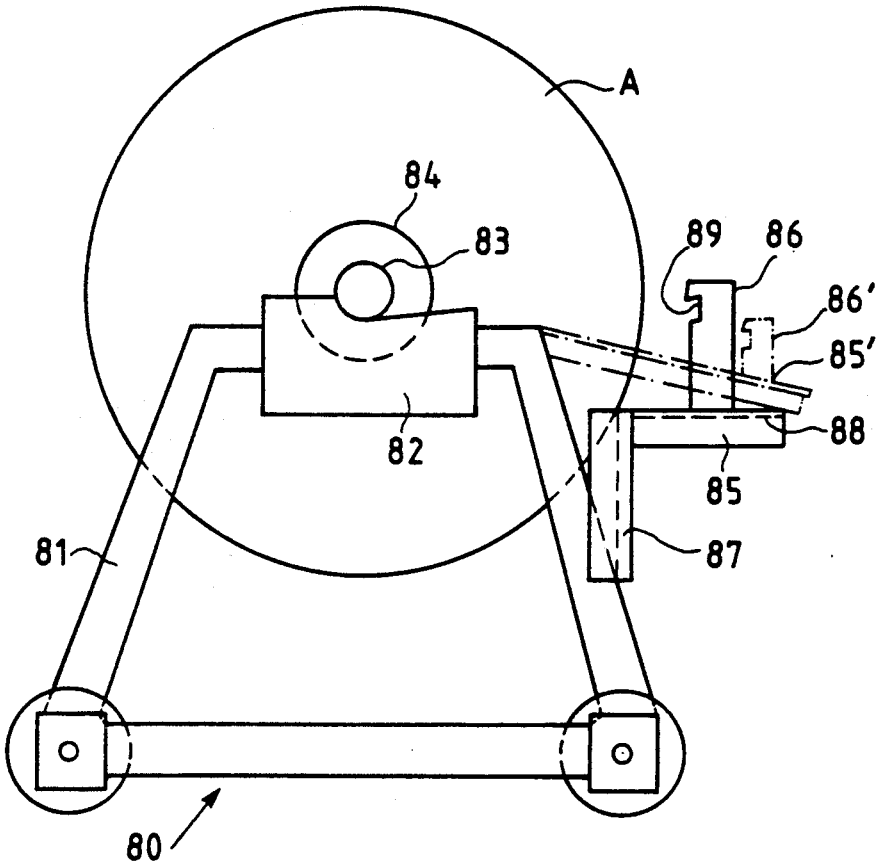
FIG. 10 shows a paper roll carriage with a guide for a cassette containing an adhesive tape.

FIG. 10 is a basic sketch of a paper roll carriage 80 where on a frame 81 a support plate 82 is provided for the shaft 83 of the core 84 of the paper roll A. Mounted on the frame 81, on both sides of the paper roll A, is a console 85 which is perpendicular to the paper roll axis or peripheral surface of the paper roll A and essentially horizontal. The console is shown supported by a holder strip 87 featuring a guide in which the console 85 can be moved vertically. The console 85 supports a guide rail 86, and at that, movable in horizontal direction in guides 88. A cassette or other unwinding device for adhesive tapes or adhesive strips can be mounted movably, and at that, along the axis of the paper roll A, on the guide rail. For the guide rail 86', as indicated by broken line, there may also be provided an essentially radial console 85' arranged relative to the paper roll axis, on both sides of the paper roll on the paper roll carriage. Not illustrated here is that the cassette or the unwinding device for adhesive tapes may be mounted on the guide rail 86 by means of a springed holder, i.e., that the cassette, for instance, might be connected by way of a spring arrangement with a slider block running in the guideway 89 of the guide rail 86.

Figure 11:
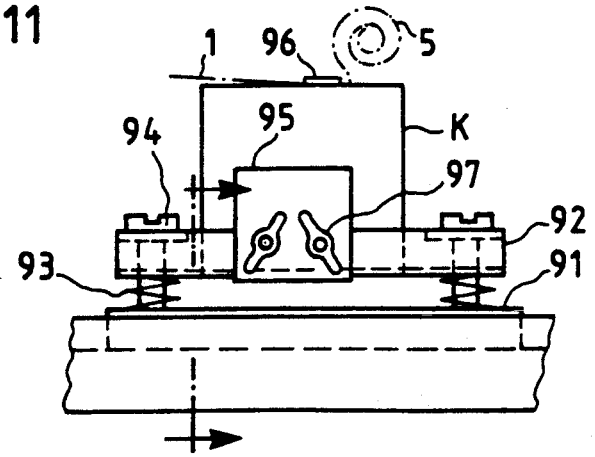
FIG. 11 shows a detail concerning the mounting, in plan view.
Figure 12:
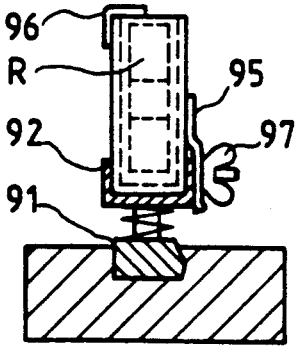
FIG. 12 shows essentially an elevation of the former, partly in section according to the dashed, heavy line in FIG. 11.

As illustrated in FIG. 11 and FIG. 12, the cassette K can be retained in the guide rail 86 by means of a slider 91 and a holder rail 92 and run along the guide rail 86. The holder rail 92 is fastened on the slider through springs 93 and bolts 94. The bolts 94 are threaded bolts, thus making it possible to exchange the holder rail 92 including the cassette for a specific cassette width. Serving that purpose is a holder plate 95 which can be fastened on the holder rail 92 by means of wing nuts 97. Also illustrated is that during the unwinding of the adhesive tape the cover foil can be separated from the adhesive tape roll R by means of a narrow, thin strip 96.

Figure 13:
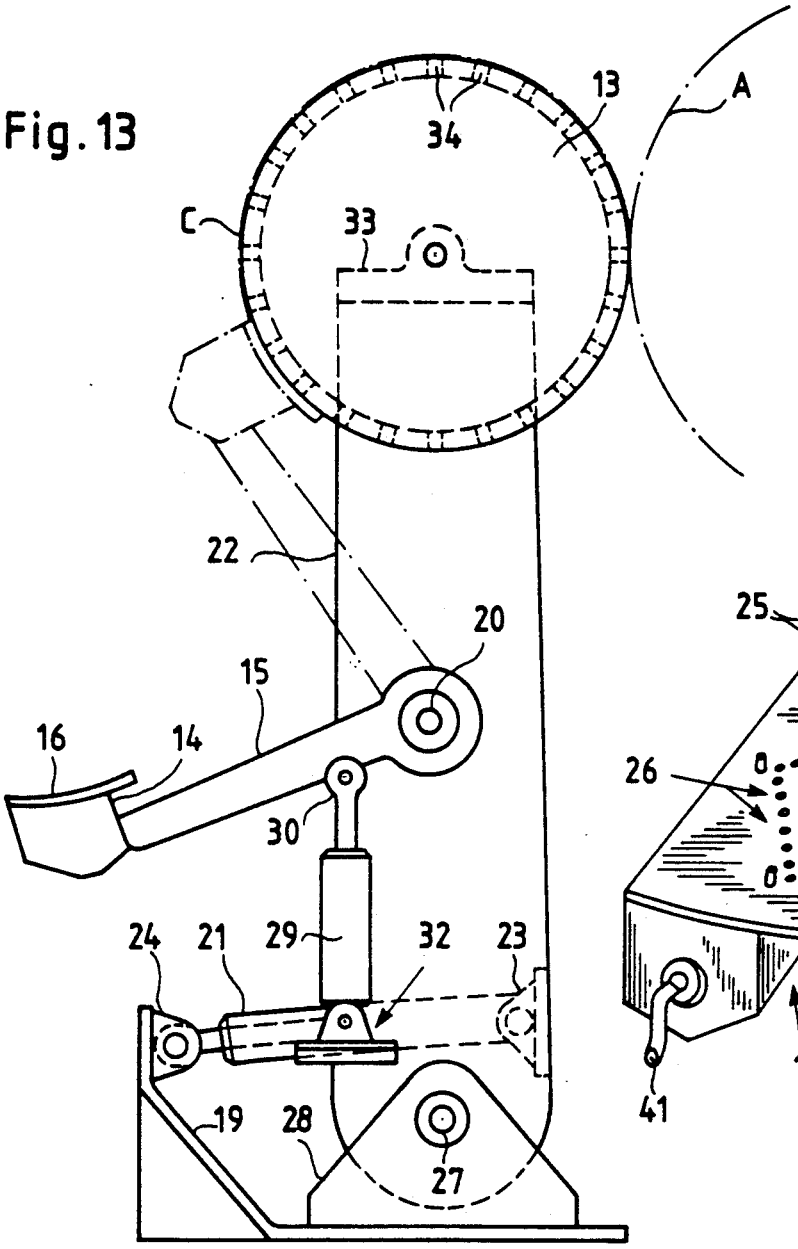
FIG. 13 shows a holder and sliding device for guiding the end of the paper web and its application on the paper roll.

FIG. 13 illustrates a device for facilitating the attachment of the adhesive tape 1 to the end C of the web. There is a pivoting frame 22 provided which on its upper end supports a guide and retaining roll 13 that is mounted in bearings 33. This retaining roll is a hollow cylinder with shell bores which connect to a vacuum, relative to the atmosphere, which is to be generated inside the retaining roll 13. The web C is held thereby on the retaining roll. Below the retaining roll 13, a worktable 14 is mounted on a lever 15 that pivots about a pivot 20 and supports a tabletop 16. The pivotal lever can be swiveled by a hydraulic jack element 29, through the intermediary of its ram 30, in the position illustrated by broken lines, in which the tabletop 16 bears on the shell surface of the retaining roll 13. The hydraulic jack element 29 is mounted on a bearing device 32 in the swivel frame 22. The latter, in turn, is swivelable by means of a hydraulic jack element 21 which, for one, is mounted on a base 19 by means of bearing element 24 and, for another, by means of a bearing element 23 on the swivel frame. The latter, in turn, pivots about the bearing point 27 on the base 19.

Figure 14:
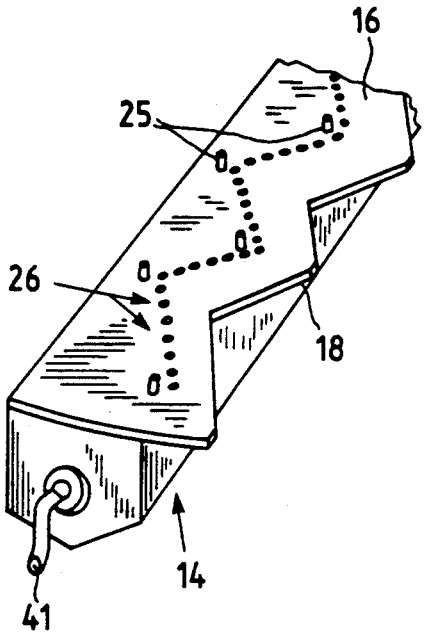
FIG. 14 shows another detail of this device.

FIG. 14, enlarged, illustrates the worktable 14 with the tabletop 16. The latter features a number of holder elements (holder pins) 25 with the aid of which it is possible to align the adhesive strip pieces on the tabletop 16. Additionally, the tabletop features bores 26. The worktable 14 being fashioned as 60 a hollow box which by means of connection 41 can be subjected to a vacuum relative to the atmosphere, this vacuum becomes effective through the bores 26, retaining the adhesive strip pieces on the tabletop 16, so that, as the latter pivots toward the retaining roll 13, these pieces can not drop off.

The adhesive tape, i.e., the pieces of adhesive tape, is placed on the worktable completely according to the form of FIG. 1 and thus applied on the end of the web C as the worktable 14 swivels up. As the guide and retaining roll 13 and the paper roll A, respectively, rotate, the end of the paper web C is guided in the attachment position relative to the paper roll A. In the process, the cover foil 8 of the narrow adhesive strip 7 is previously removed.

FIG. 14 illustrates that the tabletop features a tearing edge 18 that corresponds to the splice edge of the web end C. In the dash-dotted position of the worktable 14 according to FIG. 4, this edge can be produced by tearing the excess paper of the web end off.

Naturally, also other accessory devices are may be utilized which enable the separation of the web in the illustrated form.

Figure 15:
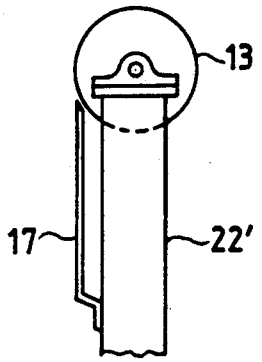
FIG. 15, another holder device of this type, in plan view.
Figure 16:
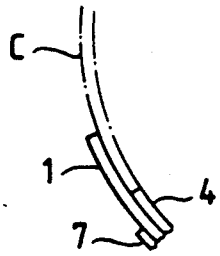
FIG. 16 shows a detail of the glued joint on the end of the paper web relative to FIG. 13.

FIG. 16 shows the position of the adhesive tape 1 where it has been taped by the worktable 14 to the web end of FIG. 4. FIG. 15 depicts a device of the guide roll 13 which does not feature the worktable 14 according to FIG. 13. Instead, there is a fixed worktable 17 provided that is fastened on the swivel frame 22'. The adhesive tape 1 or pieces thereof are applied here directly on the end of the web C by hand.

Figure 17:
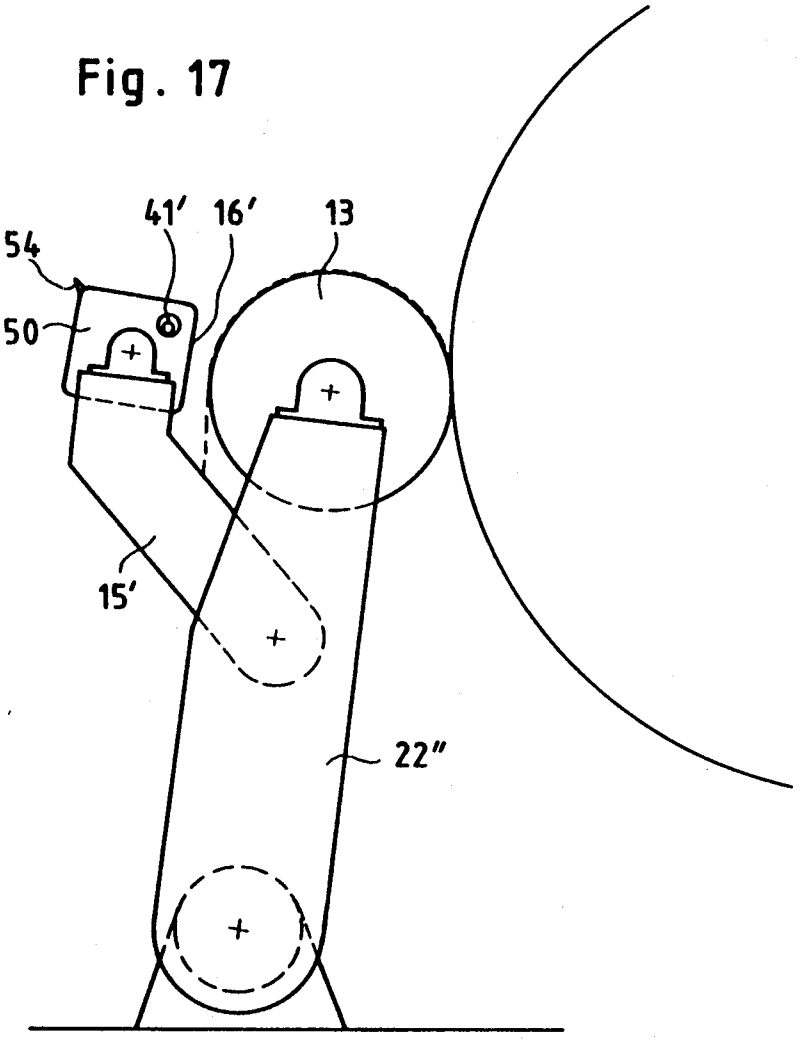

In FIG. 17, the worktable 15 is fashioned as a box with an approximately quadratic cross section. The tabletop on which the adhesive strips are placed is marked 16'. The interior of the box is hollow and preferably kept at a vacuum relative to the atmosphere, or at least partly, at any rate in the area where the table top 16' is located. To that end, a connection 41 similar to the design of the embodiment relative to FIG. 14 is to be provided (here marked 41'). Bores 26 as in the embodiment according to FIG. 14 are provided as well in the work surface. For an indented splice according to FIG. 14, the fixing pins 25 need to be provided as well, which, naturally, must be retractable in design, for instance through spring-loading.

The paper web hangs with its end, according to the broken line, over the retaining roll 13. To begin with, the worktable 50 is swiveled in a position in which the cutting edge 54 clips the paper web along an intended splicing edge. For that purpose, the shell surface of the retaining roll 13 is preferably rubber-coated. The adhesive strips which have been placed on the worktable 16' are retained by the vacuum and, upon retraction of the worktable 50 by means of swivel arm 15', rotated in a position in which the work surface 16', as illustrated in the figure, is exactly opposite the retaining roll 13. The adhesive strip can then be attached, through a controlled swivel movement of the worktable 50, also in zig-zag shape to the end of the paper web. This swivel movement can be accomplished either through a stepping motor or by means of hydraulic elements in keeping with the elements 21 and 29 according to FIG. 13, with the aid of limit switches. The swivel frame corresponds essential to that of FIG. 13 and is marked 22" here.

Figure 18:
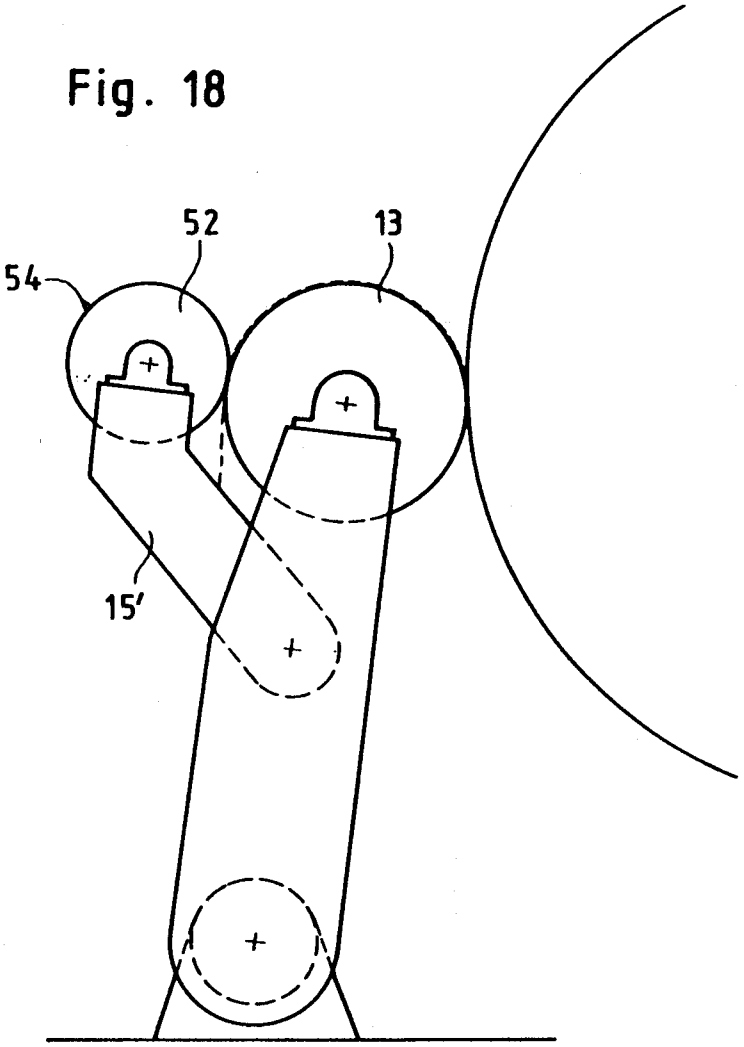
FIGS. 17 and 18 each show automatic gluing devices in other embodiments, similar to FIG. 13.

In FIG. 18, the worktable is fashioned as roll 52 formed by a hollow cylinder. It also features a cutting edge 54. The work surface should be conceived in a position comparable to the worktable in FIG. 13. Here, too, the roll 52 forming the worktable must feature a swivel or rotary drive for a specific swivel or rotary motion.

The bending resistance moment of the retaining roll 13 is preferably considerably greater than that of the worktable 16, 50 or 52.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In combination, a paper roll and a splice for said roll, wherein said splice comprises:

an adhesive tape having two sides, said adhesive tape having at least one adhesive layer on one of said sides for taping an end of an old web and a leading end of a new paper roll, said adhesive layer being affixed by adhesion to an underside of said leading end, said adhesive tape additionally having an adhesive layer on its other side whereby said other side is adhered to said web or said paper roll at an end of the outermost roll winding wherein said outermost winding is taut, said adhesive tape further having respective longitudinal edges, wherein said adhesive layer on said other side of the adhesive tape comprises at least one double-stick adhesive strip, said adhesive strip having two sides and having an adhesive layer on each of said sides, said adhesive strip being adhered at one of said sides to said other side of said tape, at least one adhesive strip being situated in closely spaced relationship to one of said longitudinal edges and being aligned generally parallel thereto, wherein the adhesion of the adhesive layer on the side of the adhesive strip adhering to said tape is considerably less than the adhesion on the other side of said adhesion strip.

2. The splice according to claim 1, wherein said adhesive tape comprises a first adhesive tape, said splice further including a second adhesive tape fastened to said first adhesive tape whereby said adhesive strip is generally interposed between said first and second tapes and adhered to each of said tapes, said second adhesive tape having a first side and a second side, wherein only said second side has an adhesive layer thereon and said first side is adhered to said adhesive strips, said adhesion of said adhesive strips to the first tape being considerably less than the adhesion of said adhesion strips to the second tape.

3. The splice according to claim 2, wherein a cover foil divided in longitudinal direction is applied to the second side of said second adhesive strip.

4. The splice according to claim 2, wherein a protective adhesive tape is applied to said paper roll, said adhesive tape being disposed in the area of first tape.

5. An adhesive tape for making a web connection to a paper roll, comprising:

a tape member having a front side and a back side, and having respective longitudinal edges, said front side of said tape member including either an adhesive layer or two mutually parallel adhesive layers separated from each other by a narrow space, said adhesive layer or layers supporting a cover foil comprising cover foil members, said cover foil members being separated by a longitudinal seam or by said space; and at least one adhesive strip having two sides and having an adhesive layer on each of said sides, said adhesive strip being adhered to said back side of said tape member by the adhesive layer of one of said sides of said strip, wherein the adhesion of the side of said adhesive strip adhered to the back side of the tape member is weaker than the adhesion of the other side of said adhesive strip, said adhesive strip extending parallel to said longitudinal edges of said tape member.

6. The adhesive tape of claim 5, wherein a cover foil is applied on the other side of said at least one adhesive strip.

7. The adhesive tape of claim 5, wherein at least one adhesive strip is situated generally adjacent each of said longitudinal edges of said tape member, said strips being aligned generally parallel to said edges, said adhesive tape further including another tape member, said another tape member having a nonstick backside wherein said nonstick backside is adhered to said other side of each of said adhesive strips.

8. An adhesive tape for making a web connection, comprising:

a tape member having a front side and a back side, and having a respective edge at each longitudinal end thereof, said front side of said tape member including an adhesive layer or two mutually parallel adhesive layers separated from each other by a narrow space, said adhesive layer or layers supporting a cover foil comprising cover foil members, said cover foil members being separated by a longitudinal seam; and at least one adhesive strip having two sides and having an adhesive film on each of said sides, said adhesive film being fashioned generally dot-shaped or as a series of adhesive areas, said adhesive strip being adhered to said back side of said tape member by the adhesive film on one of said sides, wherein the adhesion of the side of said adhesive strip adhered to the back side of the tape member is weaker than the adhesion of the other side of said adhesive strip, said adhesive strip extending parallel to said longitudinal edges of said tape member.

9. The adhesive tape of claim 8, wherein a cover foil is applied on the other side of said at least one adhesive strip.

10. The adhesive tape of claim 8, wherein at least one adhesive strip is situated generally adjacent each of said longitudinal edges of said tape member, said strips being aligned generally parallel to said edges, said adhesive tape further including another tape member, said another tape member having a nonstick backside wherein said nonstick backside is adhered to said other side of each of said adhesive strips.

11. An adhesive tape comprising:

a tape member having two sides, one of said sides having a first adhesive layer thereon and the other of said sides having a second adhesive layer thereon, said first adhesive layer being covered by a cover foil subdivided by a longitudinal seam into two parts, said second adhesive layer being disposed stripwise across said other side.

12. The adhesive tape of claim 11, in which said second adhesive layer comprises at least one film adhesive strip disposed stripwise across said other side, wherein each said film strip is covered by a cover foil.

13. A double-stick adhesive tape, comprising:

a tape member having a continuous perforation extending generally therethrough as a longitudinal seam in a center area thereof, said tape member having two sides, each side having respective longitudinal edges and having an adhesive layer thereon, wherein the adhesive layer on one of said sides is covered by a cover foil, wherein on at least one side of said perforation the adhesive layer covered by said cover foil is subdivided into two parts by a seamlike separating line, and wherein the adhesive layer on the other of said sides comprises a plurality of adhesive strips disposed generally parallel to said longitudinal edges, one of said adhesive strips being situated in closely spaced relationship to a longitudinal edge, and another of said adhesive strips being situated adjacent said perforation, said strips being situated on a common side of said perforation.

14. The double-stick adhesive tape according to claim 13, wherein said adhesive strips on said other side are covered by a cover foil.

15. In combination, a paper roll and a splice for said roll, wherein said splice comprises:

an adhesive tape having two sides, said adhesive tape having an adhesive layer on one of said sides which adhesive layer covers substantially all of said side, said adhesive tape being pierced by perforations which extend longitudinally at the central portion of said tape, said adhesive tape having double-stick adhesive strips adhered to its other side, one of said adhesive strips being situated in closely spaced relationship to a longitudinal edge of said tape and being aligned generally parallel thereto, and another of said strips being aligned in closely spaced relationship to said perforations and generally parallel thereto, each of said adhesive strips being situated on a common side of said perforations, said adhesive tape being folded over at a line defined by said perforations to form a double-stick tape wherein a folded over portion of said back side of said tape also adheres to said adhesive strips, wherein the adhesive force of said adhesive strips to said folded over back side portion is stronger than the adhesive force of said adhesive strips to said other side.

* * * * *